US006102172A

United States Patent [19]

Dercole

[11] Patent Number: 6,102,172

[45] Date of Patent: Aug. 15, 2000

[54] WHEELED COSMETIC CARRYING CASE AND METHOD

[76] Inventor: Bonnie Lee Dercole, 1122 Byrd St., Edisto Beach, S.C. 29438

[21] Appl. No.: 09/386,970

[22] Filed: Aug. 31, 1999

[51] Int. Cl.[7] ..... A45C 5/14

[52] U.S. Cl. ..... 190/18 A; 190/109; 190/125; 206/823

[58] Field of Search ..... 190/18 A, 109–111, 190/115, 117, 125; 206/235, 581, 823; 220/527, 528

[56] References Cited

U.S. PATENT DOCUMENTS

| | | | |
|---|---|---|---|
| 4,036,336 | 7/1977 | Burtley | 190/18 A |
| 5,090,526 | 2/1992 | Jacober | 190/109 |
| 5,237,838 | 8/1993 | Merritt-Munson | 62/457.2 |
| 5,524,920 | 6/1996 | Tsai | 190/18 A |
| 5,680,932 | 10/1997 | Dickinson et al. | 220/527 |
| 5,782,325 | 7/1998 | O'Shea et al. | 190/18 A |
| 5,875,876 | 3/1999 | Wang | 190/18 A |
| 5,944,155 | 8/1999 | Geary | 190/18 A |
| 5,967,270 | 10/1999 | Shyr | 190/109 |

*Primary Examiner*—Jim Foster
*Attorney, Agent, or Firm*—Ralph Bailey, P.A.

[57] ABSTRACT

A wheeled cosmetic carrying case is illustrated as including a handle and wheel assembly (A) for transporting a trunk-like box (B) with front closure member (C) fastened as by a zipper (D) over an open top of the box (B). The closure member (C) carries external compartments (E) which are zippered to open outwardly for displaying auxiliary material thus augmenting the space provided by the compartmentalized interior (F). The method includes the step of securing the closure member (C) over the trunk-like box by closing a zipper (D) for positioning externally accessible compartments as well as complementary compartments for carrying cosmetics within the box.

3 Claims, 5 Drawing Sheets

WHEELED COSMETIC CARRYING CASE AND METHOD

BACKGROUND OF THE INVENTION

This invention relates to carrying cases for organizing and transporting cosmetic products as well as for displaying them for sales purposes. More particularly, a wheeled carrying case and method is provided wherein externally mounted compartments are carried on the outside surface of a lid or closure member for a trunk-like carrying case.

Various organizers for cosmetics and jewelry for transport have been provided both for use in cosmetic sales presentations as well as for use by customers. U.S. Letters Pat. No. 4,717,024 and 5,358,100 are representative of the prior art wherein rigid cases are utilized. Cases and carrying devices constructed from flexible material have been provided heretofore and have included compartmentalized flat receptacles as well as various cosmetic containers as for example, carrying cases for lipsticks, for eye lining pencils, mascara, nail polish, and nail polish remover, and other kits of various sorts and sizes each for a specialized type of cosmetic.

The prior art has failed to provide solutions for the problem of organizing and aiding in the transport of complete cosmetic collections for use by sales personnel. Heretofore it has been necessary to carry a large number of organizational containers and cases which aid in the transport and display of particular items. Thus, a number of containers of various kinds and sizes have been utilized by cosmetic sales personnel. Lipstick products, for example, are easily damaged by extreme temperatures and it is desirable to provide protection for an entire assemblage against severe heat and cold. While wheeled devices are commonplace for transporting luggage as on trains and planes, rolling cosmetic carrying cases have been limited in scope and content.

It is an object of this invention to provide a solution to this problem by providing a single case adaptable for wheeled transport and display of a complete line of organized cosmetic products.

SUMMARY OF THE INVENTION

Accordingly, it is an important object of this invention to provide a large container for convenient transport which is capable of aiding in organizing and arranging a variety of cosmetic products and accessories for display in a single wheeled carrying case.

A further object of the invention is to provide a method of carrying and displaying cosmetics wherein a trunk-like carrying case is equipped with wheels for convenient transport utilizing a cover having external compartments as well as internal compartments supported by a lid which is fastened by a zipper to enclose the contents of further compartmentalized receptacles in a base of the trunk-like container.

A wheeled carrying case has an upright telescoping handle and wheel assembly for supporting a trunk-like box for rolling and transporting. A lid or closure member covers a top of the box and is fastened on three sides with a zipper opposite an upright side of the lid that is thereby secured for pivotal mounting so as to swing from open to closed positions. The lid contains both externally mounted compartments and internally mounted compartments which are easily accessed for loading, carrying, and displaying cosmetics.

Another important object of the invention includes the provision of a pull-out stabilizer bar on the bottom of the assembly to prevent the trunk-like box from tipping over especially when the external compartments are opened so as to tilt outwardly for exposing their contents. This places added weight overhanging the base of the wheeled trunk tending to tip the carrying case over. Suitable cam locking mechanisms are provided on the telescopically mounted upright bars of a Pullman-type handle. Side handles are provided such as on a trunk for ease in lifting the assembly in and out of vehicles. An auxiliary carrying case may be strapped on top of the trunk-like box for transport with the assembly.

Another important object of the invention is to provide insulation at the outside of cover members so as to surround the carrying case and its contents. Insulation includes flat sheet insulating material as well as a foil thermal barrier such as thermofoil.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

A wheeled carrying case includes an upright, elongated telescoping handle and wheel assembly A. An elongated, rectangular, trunk-like box B has a base arranged in upright relation for securement to the handle and wheel assembly. A closure member C extends across an open top of the box opposite the base and is foldably connected as by a pivotal connection on one upright side to a corresponding upper side of the box. A zipper fastener D extends about the other side and ends of the closure member for securing the closure member over the open top of the box. Externally mounted compartments E constructed of sheet materials are carried on an outside surface of the closure member. A compartmentalized interior F is provided within the box for containing cosmetics and accessories. The method contemplates folding the closure member C in hinged relation on one side to cover the open top and closing a zipper on the opposite sides for securing the internal contents of the trunk as well as the contents of the external compartments.

Figure 1:
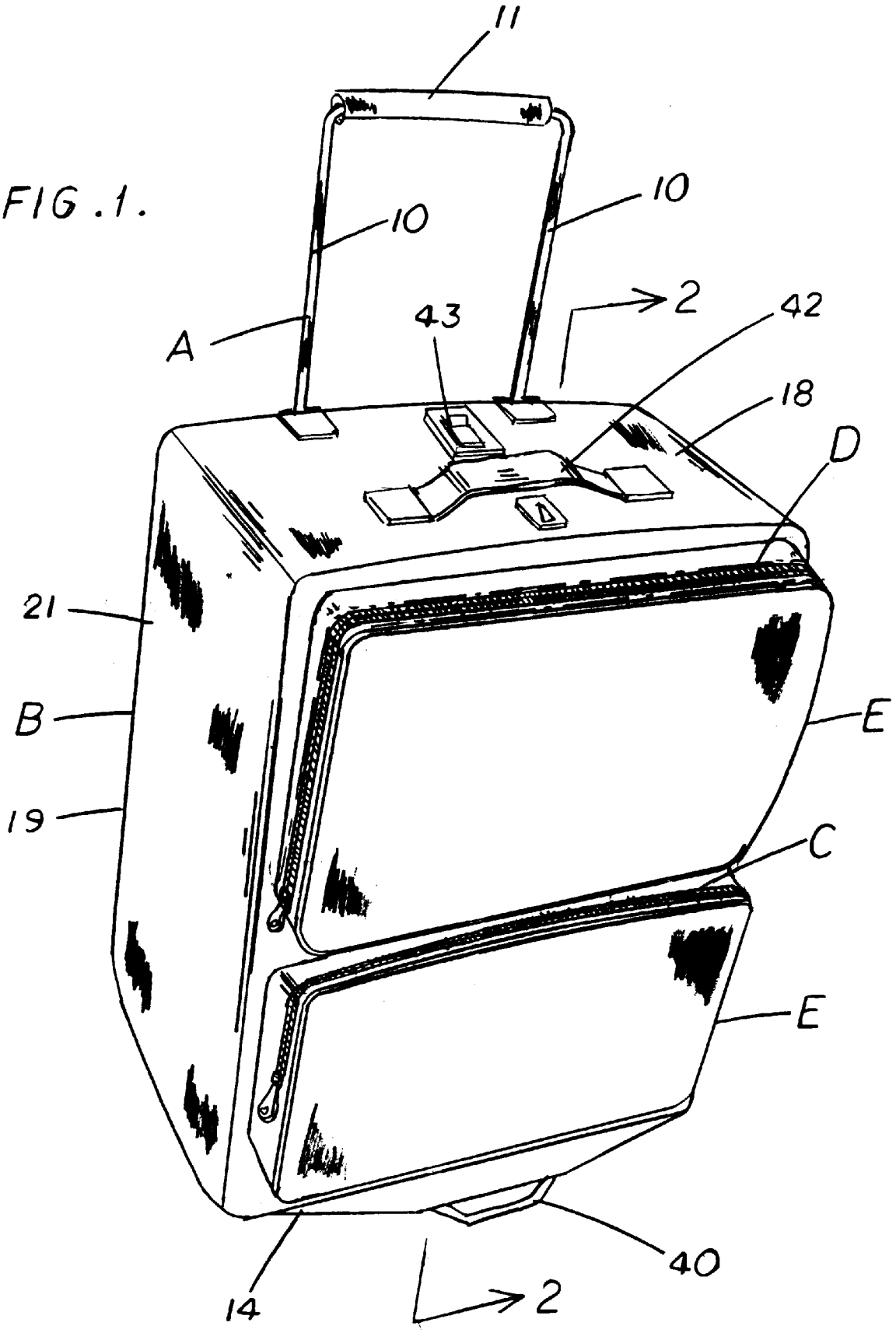
FIG. 1 is a front prospective view illustrating a wheeled carrying case constructed in accordance with the invention with a telescoping handle in raised position while a retractable stabilizer bar is extended to a forward position to stabilize the case especially when the external compartments are tilted forwardly to be open at respective tops.
Figure 2:
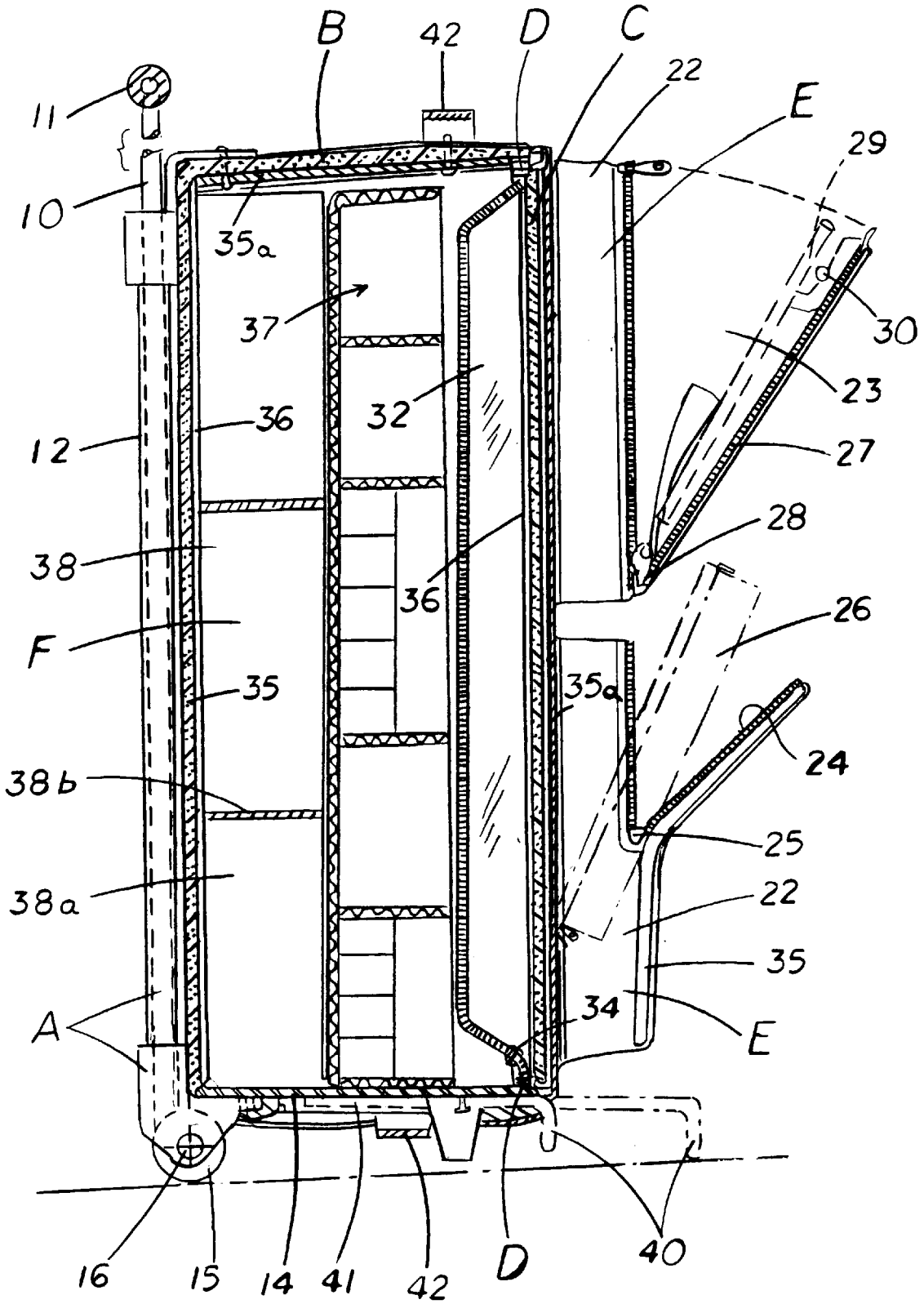
FIG. 2 is a longitudinal, sectional elevation taken on the line 2—2 in FIG. 1 illustrating the closure member or lid in closed position being zipped on three sides around an open top of the trunk-like container further illustrating the handle and wheel assembly and pull-out stabilizing bar. The external compartments are illustrated in open position on the front face of the closure member. The trunk side handles as well as the various insulation and external trays as well as compartmentalized areas of the contents of the trunk are shown.
Figure 3:
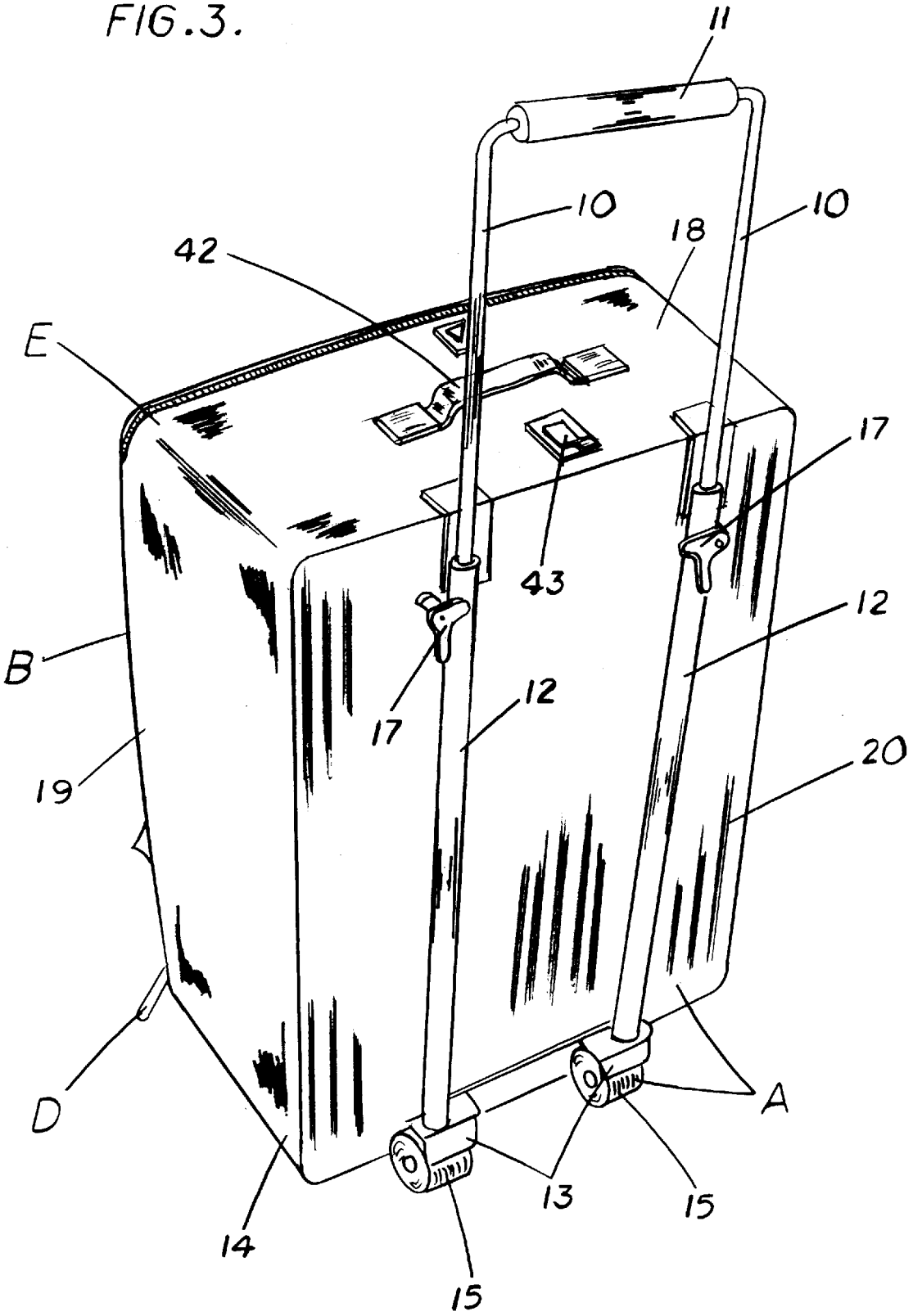
FIG. 3 is a rear perspective view illustrating the trunk-like carrying case and wheel assembly with locking arms for maintaining the handle in raised position for transport.

Referring more particularly to FIGS. 1–4, the transverse Pullman handles of the assembly A is illustrated as including upright bars 10 which are bridged at the top so as to provide a hand gripper 11. FIGS. 2 and 3 illustrate spaced upright tubular members 12 for receiving the spaced handle members 10. A bracket 13 is fixed to a lower end 14 of the carrying case for supporting suitable wheels 15 carried on spaced transverse axles 16 as shown in FIG. 2. At the top of the receptacles 12 a pair of camming latches 17 are provided for releasably securing the handle in raised position as shown in FIGS. 1 and 3.

The elongated rectangular trunk-like box B is illustrated in FIGS. 1 and 3 as including an open top 18 opposite the bottom 14, sides 19 and a flexible back panel 20. The box has a closure member C which is zippered on three sides opposite an upright foldable connection. A foldable or pivotal connection is provided by a flexible connecting member 21 which is positioned opposite the zipper fastener D which extends about the opposite three sides.

The externally mounted compartments E are carried by the outer surface of the closure member D and are best illustrated in FIG. 2 in outwardly pivoted open position. Each of the compartments E has flexible side members 22 and the upper compartment has flexible end members 23 for limiting outward pivotal movement. The lower compartment has a zipper 24 which terminates as at 25 in a central part of the compartment so as to accommodate a plastic tray 26 which may be placed in outwardly projecting position as shown in FIG. 2 or confined entirely within the compartment. The upper compartment has a zipper 27 which extends entirely about the three sides opposite the flexible connecting member 28 at the bottom. The upper compartment may contain an order pad 29 together with a pen or pencil 30.

Figure 4:
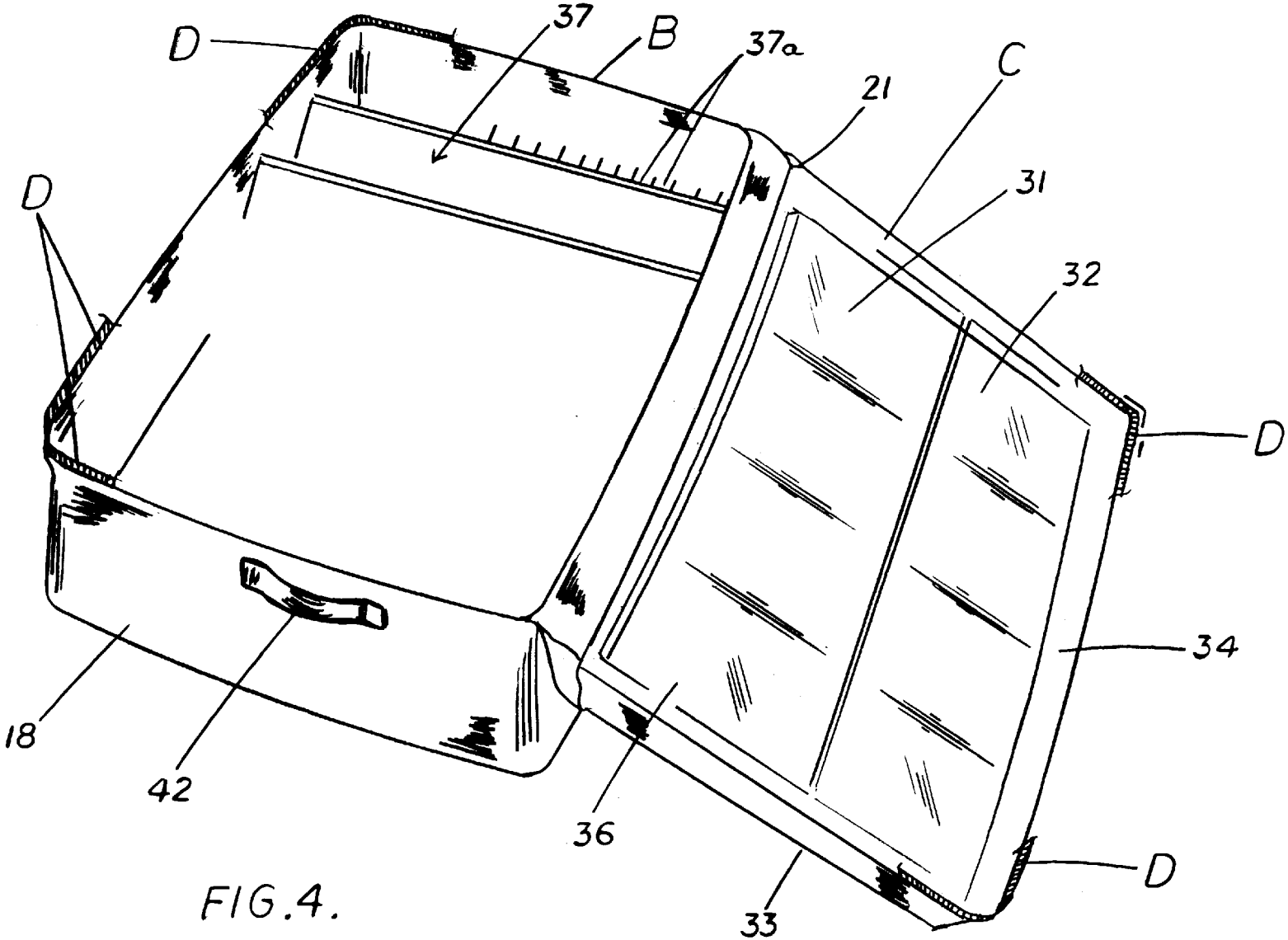
FIG. 4 is a top perspective view illustrating the trunk-like carrying case with the closure member in open position showing internal compartments carried upon an inside surface of the closure lid opposite the externally mounted compartments on the outside of the lid.

Inner compartments are carried on an inner face of the closure member C and are best illustrated in FIGS. 2 and 4. The compartments are shown in FIG. 4 as dividing the inner surface of the closure member C by flexible transparent plastic such as clear vinyl as illustrated at 31 and 32. Zippers 33 and 34 are provided for closing each of the inner compartments.

The interior construction of the inner and outer compartments preferably includes an insulating foam layer or sheet 35 together with a foil thermal barrier 36 shown in FIG. 2. The barrier is preferably of gold thermofoil. The thermal barrier 36 extends on all sides front and back as well as top and bottom of the trunk and is used in conjunction with an insulating sheet 35 on the interior of the trunk-like box B. The box contains a suitable compartmentalized tray broadly designated at 37. In FIGS. 2 and 4 the tray 37 is illustrated as including compartments 37*a*. The tray is suitably supported as by a divider 38 which includes an elongated member 38*a* as well as cross members 38*b* for compartmentalizing the area beneath the tray for carrying auxiliary or accessory items such as kits and the like. Stiff panels 35*a* may be provided on the sides and closure members of the box which may be covered with suitable sheet material which is preferably waterproof.

Figure 5:
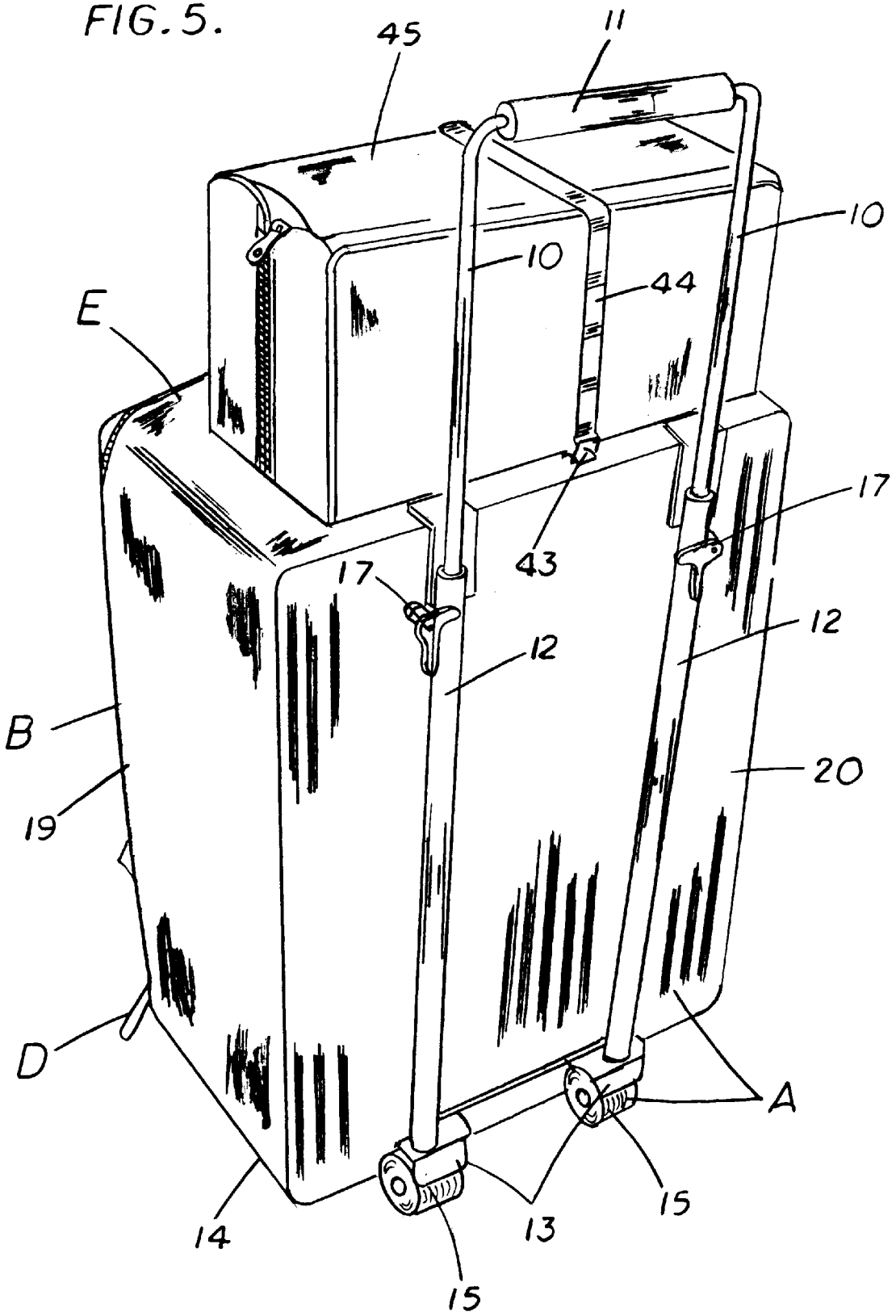
FIG. 5 is a perspective view similar to FIG. 3 illustrating an alternate form of the invention wherein a showcase accessory is secured on top of the carrying case.

FIGS. 1 and 2 illustrate the stabilizer bar 40 which is shown in extended broken line position in FIG. 2. The extended position is also shown in FIG. 1. The stabilizer bar is extensibly carried within a receiving member 41 carried on the bottom 14 of the case. As is best illustrated in FIGS. 1–4 suitable trunk handles 42 extend across the top and bottom of the trunk-like case B to aid in removing the carrying case from a vehicle preparatory to making a sales presentation. A strap may be connected on one end upon a support fixture 43 shown in FIG. 5 with the strap extending over the top of an auxiliary case 45. Thus, an additional supply of cosmetics and accessories as for demonstration may be carried in the wheeled assembly with the stabilizer bar extended to aid in balancing the wheeled assembly.

While a preferred embodiment of the invention has been described using specific terms, such description is for illustrative purposes only, and it is to be understood that changes and variations may be made without departing from the spirit or scope of the following claims.

What is claimed is:

1. A cosmetic carrying case on wheels comprising;

an upright, elongated telescoping handle and wheel assembly;

an elongated, rectangular, trunk-like box having a base arranged in upright relation for securement to the handle and wheel assembly;

a closure member extending across an open top of the box opposite the base foldably connected on one upright side to a corresponding open top of the box;

said base and said top being major external surfaces of the box;

a zipper fastener extending about the other side and ends of the closure member for securing the closure member over the open top of the box;

at least one externally mounted compartment constructed of flexible sheet material on an outside surface of the closure member; and at least one interior compartment extending across an inside surface of the closure member;

a foil thermal barrier extending as a liner covering generally an entire inside surface of the trunk-like box and the closure member for aiding in protecting the contents of the box against high temperatures; and a compartmentalized interior within the box for containing cosmetics.

2. The cosmetic carrying case set forth in claim 1 including a divided tray in the box, and a divider compartmentalizing a lower portion of the box and supporting of the divided tray within the box.

3. The cosmetic carrying case set forth in claim 1 including a fastener at an upper end of the box for use in securement of an auxiliary carrying case on top of the box for transport, and a retractable stabilizer bar extending forwardly at a lower end of the handle and wheel assembly for balancing the carrying case in upright position.

* * * * *